US006435219B2

(12) United States Patent
Griessbaum

(10) Patent No.: US 6,435,219 B2
(45) Date of Patent: Aug. 20, 2002

(54) METHOD FOR MANUFACTURING A WOVEN ZIPPER HALF

(75) Inventor: Karl Griessbaum, Essen (DE)

(73) Assignee: William Prym GmbH & Co. KG, Stolberg (DE)

( * ) Notice: Subject to any disclaimer, the term of this patent is extended or adjusted under 35 U.S.C. 154(b) by 0 days.

(21) Appl. No.: 09/725,379

(22) Filed: Nov. 29, 2000

Related U.S. Application Data

(63) Continuation of application No. PCT/DE99/01568, filed on May 28, 1999, now abandoned.

(30) Foreign Application Priority Data

May 30, 1998 (DE) ..... 198 24 432

(51) Int. Cl.[7] ..... A44B 19/54
(52) U.S. Cl. ..... 139/22; 139/38 B; 139/11
(58) Field of Search ..... 139/22, 384 B, 139/11

(56) References Cited

U.S. PATENT DOCUMENTS 3,905,401 A * 9/1975 Steingruebner ..... 139/11
3,976,106 A * 8/1976 Porepp ..... 139/11
4,924,914 A * 5/1990 Heimberger ..... 139/11

FOREIGN PATENT DOCUMENTS

| | | |
|---|---|---|
| DE | 1610411 | 4/1971 |
| DE | 3031654 | 11/1982 |
| DE | 3717868 | 9/1988 |
| DE | 3738214 | 11/1990 |
| EP | 0124129 | 2/1987 |
| FR | 2278810 | 2/1976 |
| FR | 2400860 | 3/1979 |

* cited by examiner

*Primary Examiner*—Andy Falik
(74) *Attorney, Agent, or Firm*—Friedrich Kueffner

(57) ABSTRACT

A woven strip of a zipper half is produced of warp and weft threads. The weft thread is picked in the form of double pick loops. A plastic monofilament forms windings of a closing member row on the woven strip with interlocking heads at one end and winding reversing portions at the other end. During weaving, a main knit thread is guided upwardly between the windings to the upper side of the closing member row to form loops with loop heads that are interlocked by crocheting and form a mesh structure for interlocking the closure member row with the woven strip. Simultaneously, double pick loops of the main knit thread are formed and are interlaced during weaving with additional warp threads positioned underneath the closing member row. The main knit thread is used as a weft thread in the woven strip underneath the closing member row.

15 Claims, 8 Drawing Sheets

6
2
6
15
6a
13
4
27
8c
8b
25
13
21
10
11
17
25
8c
12
15
24
8
6a
16
1
38
3

3a
4
2
6
6a
8b
8c
25
12
10
11
1,38
8c
17
16
8
38

Fig. 5a
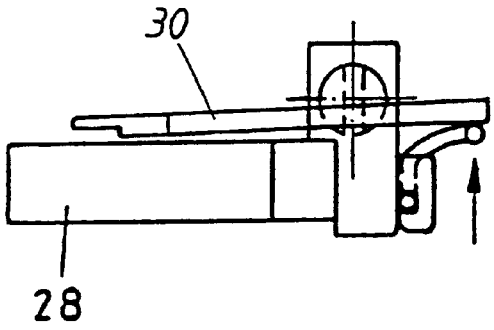
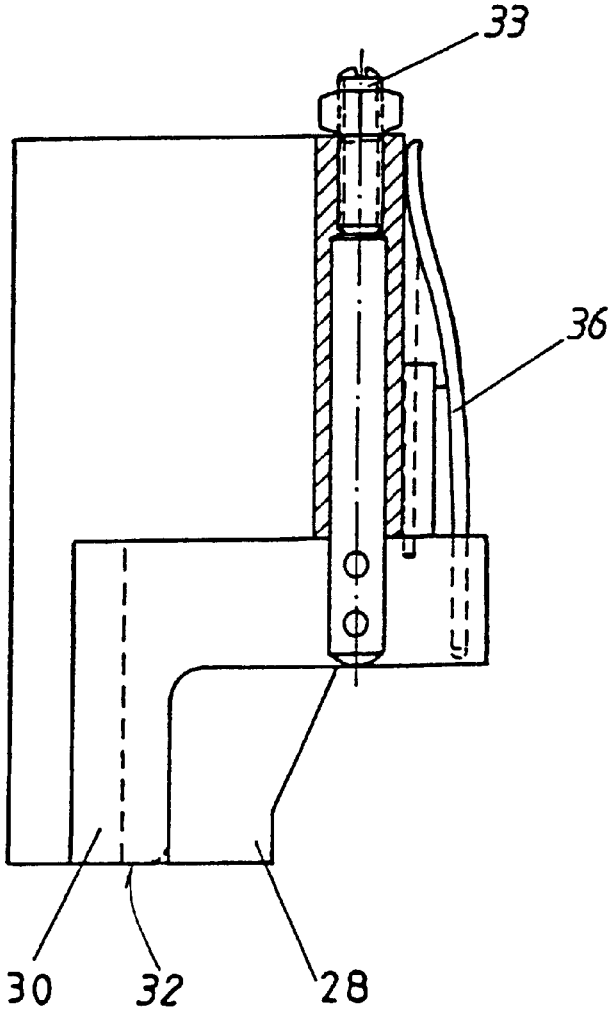
Fig. 5b

Fig.6a
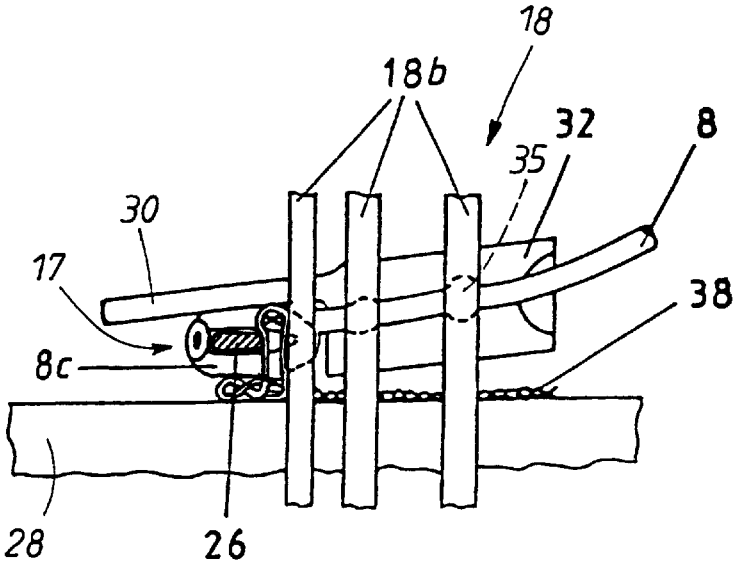
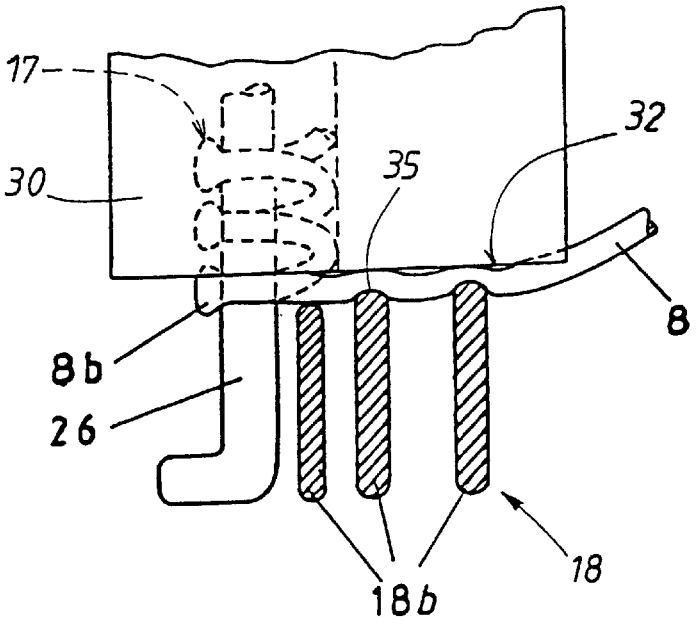
Fig.6b

METHOD FOR MANUFACTURING A WOVEN ZIPPER HALF

This is a continuation of International Application PCT/DE99/01568, with an international filing date of May 28, 1999, now abandoned.

BACKGROUND OF THE INVENTION

1. Field of the Invention

The invention relates to a method for manufacturing a woven zipper half, wherein a woven ribbon is produced of warp threads and of at least one weft thread, wherein the weft thread is picked in the form of double pick loops, wherein a wound closing member row is produced whose member-forming windings have interlocking heads at their one end and winding reversing portions at their other end, wherein the closing member row is positioned on a woven strip, and wherein during weaving at least one knit thread is guided through the gap between the windings upwardly to the upper side of the closing member row and its loop heads are interlocked by crocheting, wherein the crocheted loop heads form a mesh or stitch structure which covers portions of the upper side of the closure member row and connects the closing member row with the woven strip. Accordingly, such a zipper half is comprised, on the one hand, of a closing member row and, on the other hand, of a woven ribbon which are connected to one another in a weaving-technological way. The woven ribbon is woven of warp threads and of at least one weft thread wherein the weft thread is picked in the form of double pick loops. The closing member row is comprised of a wound plastic monofilament thread whose closing member-forming windings have interlocking heads at their one end and winding reversal portions at their other end. During weaving the closing member row is laid on a woven strip.

2. Description of the Related Art

The interlocking between the woven strip and the closing member row is realized by a knit thread which during weaving is lifted out of the woven strip in the form of loops and guided through gaps between the windings of the member row to the upper side of the closing member row where its loop heads are then interlocked by crocheting. The crocheted stitch heads form a mesh or knit structure. While the woven strip is positioned at the underside of the closing member row, the knit structure covers the upper side of the closing member row.

In the known method of this kind (German patent document DE 24 34 978 A) interlacing threads are present in the woven strip produced beneath the closing member row. They form a shed and interlock with a uniform weft extending across the entire width of the woven ribbon. This weft is picked as double pick loops, wherein the picking is carried out from the edge of the woven ribbon which carries the closing member row. Accordingly, at the oppositely positioned edge of the ribbon the projecting loop heads of this double pick must be interlocked by crocheting with one another, for which purpose a separate hook needle is required. Accordingly, a crocheted ribbon edge results which impairs the pleasing appearance of the zipper half. During weaving of the ribbon the sections of the interlacing thread are lifted in loops out of the resulting woven strip and penetrate through the loops between the windings of the closing member row to the upper side. Here, the produced loop of the interlacing thread is interlocked by crocheting with a preceding, already produced loop of another interlacing thread. For this interlocking by crocheting process, a second hook needle is required. Portions of the interlacing thread thus form loop-shaped knit threads. As a result of the woven strip below the closing member row and of the crocheting of the loop heads at the upper side, interlocking of the closing member row with the woven strip results. Not only a catch fork which provides the loop formation but also a second hook needle is required for controlling the interlacing threads during weaving. In order for the catch fork of the correspondingly selected partial piece of a certain interlacing thread to be gripped, a precise control is required. This known method is complex and failure-prone.

SUMMARY OF THE INVENTION

It is an object of the present invention to provide a reliable method of the aforementioned kind in which the product has a clean selvedge without a crocheted edge even though a woven ribbon with double picking has been woven.

In accordance with the present invention, this is achieved in that underneath the closing member row additional warp threads are positioned and that the loop-shaped knit thread at the same time forms the double pick loops which during weaving are interlaced with the additional warp threads, and the knit thread generates the weft thread in the woven strip underneath the closing member row.

According to the invention, warp threads are positioned underneath the closing member row which in the finished product are positioned exclusively in the plane of the woven strip that has been produced beneath the closing member row and which are not interlocked by crocheting with one another. In the following these threads will be referred to as "additional warp threads". The special feature of the invention is that the knit thread forms at the same time the weft thread in the woven strip and interlocks during weaving in the form of double pick loops with the additional warp threads present in the woven strip. When interlocking with the additional warp threads, the double pick loops are guided through the gaps between the windings of the closing member row and their loop heads are interlocked by crocheting on the upper side of the closing member row. This crocheting action of the double pick loops cover portions of the upper side of the closing member row. The double picking of the knit thread produces thus at the oppositely positioned edge of the woven strip a clean, stitch-free selvedge. The produced zipper half has an excellent visual appearance.

The hook needle for interlocking the double pick loops of the knit thread acting like a weft is the same hook needle which produces the cover of the closing member row at the upper side. In comparison to the prior art, two components have been eliminated, i.e., a catch fork and a second hook needle for the loop ends of the double picks. The picking of the knit thread is realized by the weft needle and this weft needle produces not only the weave interlocking with the additional warp threads in the woven strip beneath the closing member row but also forms at the same time the loops penetrating between the gaps of the windings of the closing member row which are then crocheted with one another at the upper side. In addition to the hook needle, only a single tool is thus required, i.e., the weft needle. This weft needle is not only a weft picking means for the knit thread in the woven strip but also the loop head forming means of the knit thread for the hook needle.

The interlocking by crocheting of the loop heads generated from the knit thread can be realized by a direct stitch-like interlacing. However, it is further suggested to perform this also indirectly. For this purpose, an auxiliary thread is provided which realizes the stitch-like interlocking. Moreover, such an auxiliary thread, in addition to the stitch formation between the loop heads of the knit thread, can also effect a separate stitch-like interlocking between the closing member row, on the one hand, and the woven strip positioned underneath, on the other hand. With such an additional auxiliary thread the interlocking between the closing member row and the woven strip positioned underneath is improved.

In most applications, in addition to the woven strip with the closing member row positioned thereon, a wide support ribbon is also desirable which extends as a projecting web adjacent to the closing member row. Such a support ribbon is provided, for example, for attaching the zipper half by sewing on a piece of clothing which is to be provided with a zipper. The excellent appearance of the zipper half according to the invention is improved in that such a support ribbon is comprised of support ribbon warp threads and of a support ribbon weft which itself is picked in the form of double pick loops into the support ribbon warp threads. The support ribbon double pick also produces loop heads which, according to the method of the invention, are arranged in the zone where the loops of the knit thread, picked into the neighboring woven strip, penetrate through the gaps between the windings of the closing member row. The loops of the knit thread secure thus the loop heads of the support ribbon double picks before they are interlocked in a stitch-like manner with one another at the upper side of the closing member row, as has been mentioned above. Also, at the free edge of the support ribbon a flawless selvedge results because within this selvedge the support ribbon double pick enters the shed which is provided by the support ribbon warp threads. The woven material of this product than has clean selvedges on both sides. This has previously not been possible in the prior art when employing doubled picks.

With the afore described measures, a hook needle, which would be otherwise required for the stitch formation of the loop heads of the support ribbon double pick loops, can be eliminated at the free selvedge of the support ribbon. The knit thread has a triple function for such a zipper half comprising a support ribbon. The first function is, as mentioned before, that the knit thread as a weft thread produces the woven strip underneath the closing member row. The second function is that the knit thread interlocks the closing member row with the woven strip underneath because it is at the same time the weft thread in this woven strip. The third function of the knit thread is to interlock the support ribbon with the woven strip.

According to the invention, portions of the closing member row are covered at the underside by the already mentioned woven strip. On the opposite side, the already mentioned stitch-like interlocking of the loop heads of one or more knit threads or auxiliary threads is provided. In addition, or as a supplement thereto, at the upper side of the closing member row additional warp threads can be provided which interlock with such knit threads and thus form a woven material at the upper side which covers the member row even better.

It is advantageous in the context of the method according to the invention to wind the closing member row during weaving of the woven strip and/or of the support ribbon of a plastic monofilament thread by weaving-technological means. The manufacture of the individual closing members and their aforementioned interlocking is carried out in conformity with the knit threads acting in the woven strip in the manner of a weft thread. The adjusted winding of the closing member row and the interlocking weaving of the individual closing members formed of these windings provides a precise interlocking of the closing member row with the woven strip.

BRIEF DESCRIPTION OF THE DRAWING

In the drawing:

FIG. 5*a* shows a rear view of a weaving support used in the weaving machine of FIG. 2 and having a cover mounted thereon, wherein the other components of the weaving machine arranged in this area have been omitted;

FIG. 5*b* shows a plan view of the weaving support of FIG. 5*a* with mounted cover, wherein the components of the weaving machine arranged in this area have been omitted;

FIG. 6*a* shows a cross-section of the weaving machine and a view from the rear onto the weaving reed and the woven ribbon with the closing member row produced downstream thereof, wherein machine components obstructing the view have been omitted; and FIG. 6*b* shows a view from above onto the portion of the weaving machine illustrated in FIG. 6*a* showing the weaving reed in horizontal section.

DESCRIPTION OF THE PREFERRED EMBODIMENTS

Figure 1:
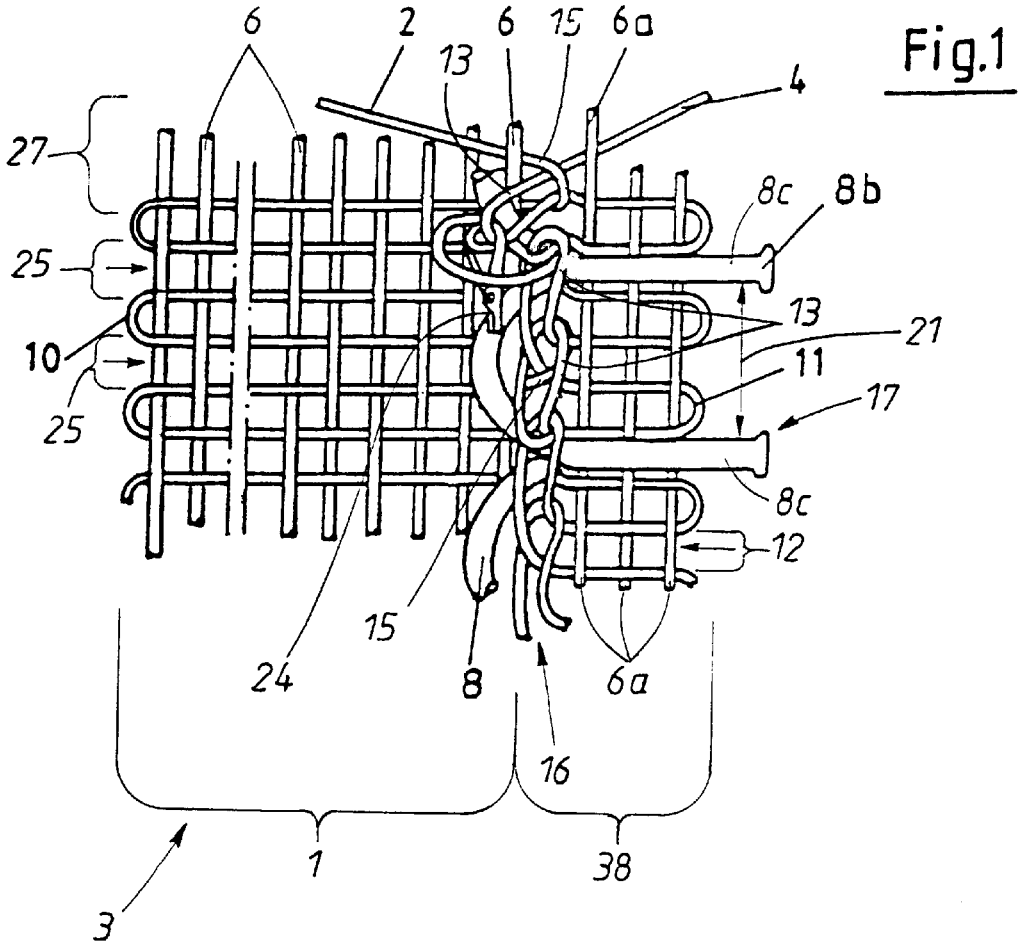
FIG. 1 is a plan view onto a portion of a woven ribbon with interlocked closing member row illustrating the resulting thread interlocking at the weaving location at the upper edge, wherein the closing members are arranged at a greater spacing relative to one another.
Figure 1A:
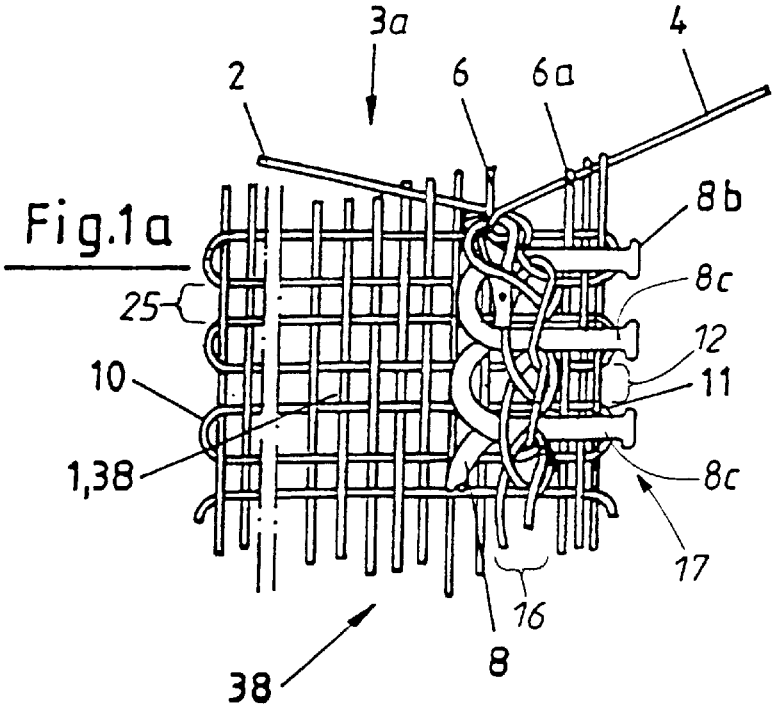
FIG. 1*a* is a plan view corresponding to that of FIG. 1 onto the woven ribbon where the closing members are positioned at a smaller spacing relative to one another and the interlocking of the closing member row with the woven material is realized by a knit thread only.
Figure 1B:
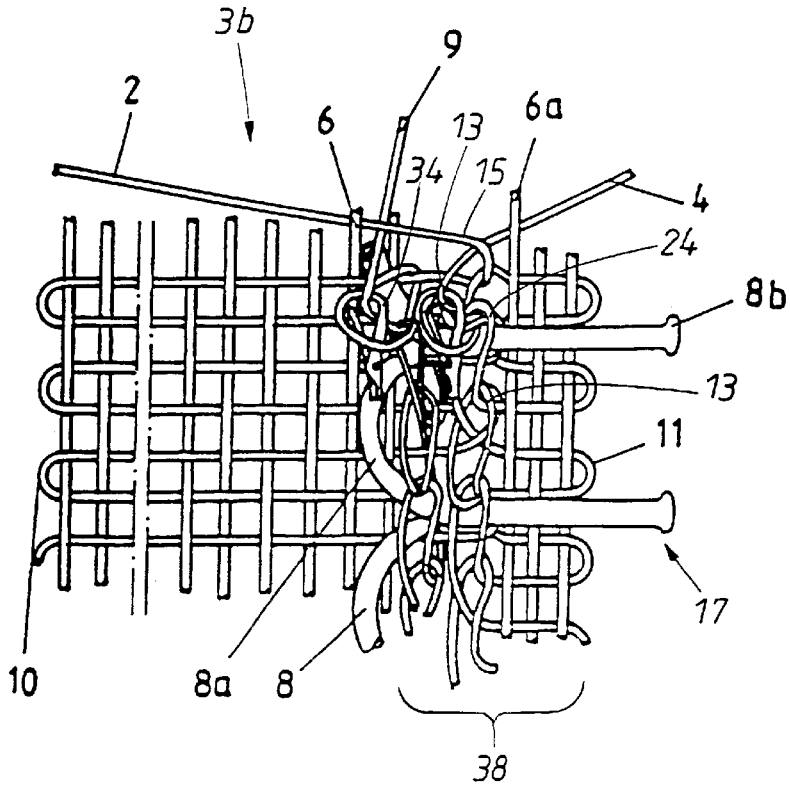
FIG. 1*b* is a second alternative to FIG. 1, where, in addition to the knit thread of FIG. 1, a further auxiliary thread interlocks the closing member row with the woven material by means of a second hook needle.
Figure 1C:
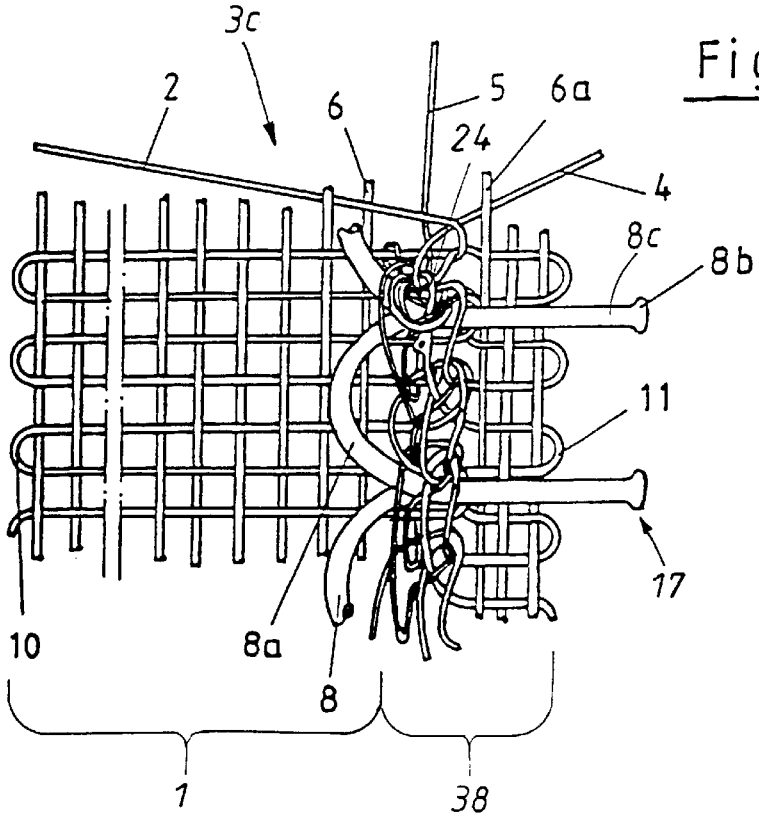
FIG. 1*c* is a third alternative to FIG. 1 with an additional auxiliary thread.
Figure 1D:
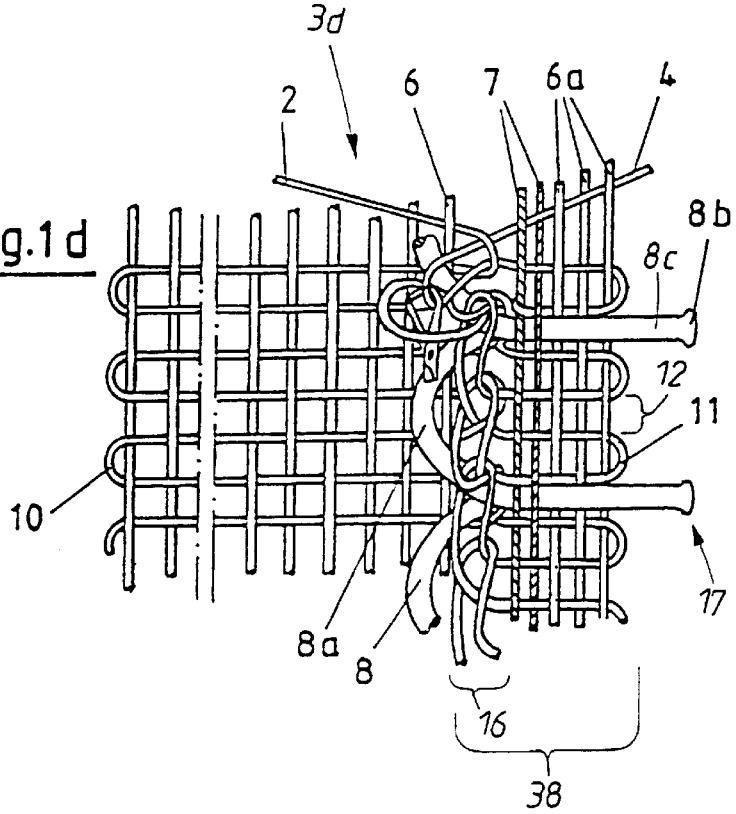
FIG. 1*d* is a further variant of that shown in FIG. 1, wherein the closing member row is covered at its upper side by special warp threads.
Figure 1E:
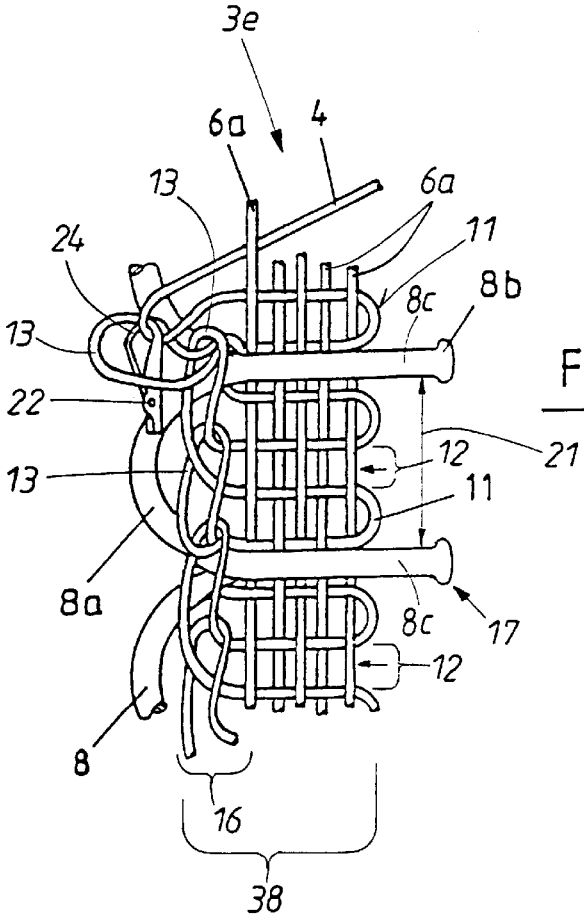
FIG. 1*e* is an illustration analog to FIG. 1 of an alternative to the woven ribbon illustrated in FIG. 1, where only the woven strip underneath the closing member row is woven and a support ribbon outside of the closing member row is missing.

The simplest product 3*e* of the method according to the invention is illustrated in FIG. 1*e*. This zipper half 3*e* is obtained when an actual support ribbon is not required for whatever reasons. In this embodiment, a closing member row 17 is interlocked by means of a main knit thread 4 with a woven strip 38 positioned underneath the closing member row 17 in a weaving-technological way. The knit thread 4 is picked in the form of double picks 12 from the right side into a shed which is formed by warp threads 6*a*. The closing member row 17 is comprised of a plastic monofilament thread 8 which extends in windings and produces thereby closing members 8*c*. The closing member row 17 comprises at its longitudinal edge interlocking heads 8*b* and at the oppositely positioned longitudinal edge rearward arcs 8*a*. Free gaps 21 are positioned between the closing members 8*c*.

During weaving of the zipper half 3*e* according to FIG. 1*e*, the woven strip 38 is produced of the weft or filling threads 12 and the warp threads 6a underneath the closing member row 17, but the loop heads 13 of the double picks 12 are guided through the closing member gaps 21 and are interlocked by crocheting to one another by means of a hook needle 24. The loop head 13 is guided through the loop interior of the preceding loop head 13. This forms a mesh or stitch structure 16 at the upper side of the member row 17.

The product 3*e* of FIG. 1*e* uses the loop heads 13, which results at one edge by means of a double pick 12 of the knit thread 4, in order to interlock as a result of their crochet interlocking with one another the closing member row 17 and the woven strip 38 by weaving. As a result, the oppositely positioned selvedge 11 of this product 3*e* is smooth. The zipper half 3*e* has an attractive appearance.

The support ribbon in the product 3*e* of FIG. 1*e* can, in principle, be eliminated, and the product 3*e* can be directly worked into a final product. However, when subsequently a support ribbon is desired for this product 3*e*, it is produced in this case separately and then connected to this product 3*e*. However, it is more advantageous when already during the weaving process, which produces the woven strip 38 with the closing member row 17, the support ribbon is woven together with woven strip 38. This will be explained in more detail in connection with FIG. 1.

Figure 4:
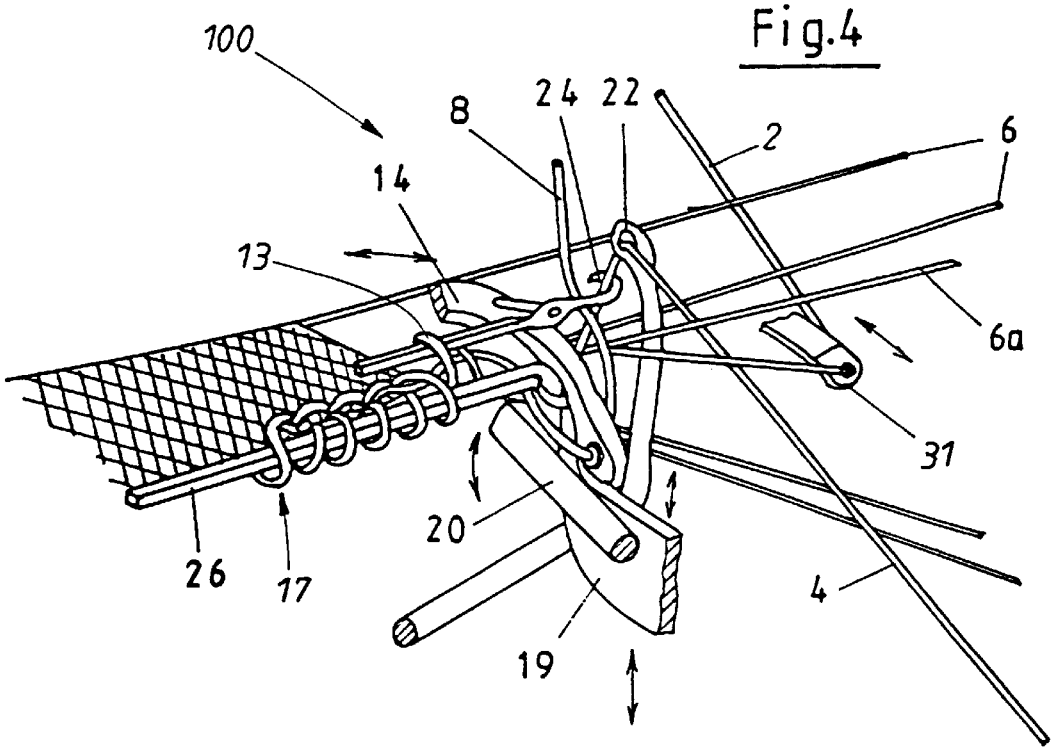
FIG. 4 is a another perspective view of the needle ribbon weaving machine according to FIG. 2, with a closing member row being produced.

FIG. 1 differs from FIG. 1*e* in that in addition to the afore described woven strip 38 with the closing member row 17 the actual support ribbon 1 is formed. The support ribbon 1 is produced of warp threads 6 and a weft thread 2 which is also interlocked in the support ribbon 1 in the form of double picks 25. The ends of these support ribbon double picks 25 form again loop heads 15. In this embodiment, they are not interlocked with one another but instead by means of the main knit thread 4 of the woven strip 38. For this purpose, as illustrated on the selvedge 27 of FIG. 1, the loop head 13 is pulled by the knit thread 4 through the interior of the loop head 15. By means of the resulting stitch or mesh structure 16 produced from the knit thread loop heads 13, the support ribbon loop heads 15 are also secured. Accordingly, a clean and smooth selvedge 10 is also formed at the free edge of the support ribbon 1. As is illustrated in FIG. 4, the main knit thread 4 is formed to a loop by a lifting needle 22, which serves as a picking means for the weft into the woven strip 38, and the resulting loop heads 13 are then knitted with one another by means of a hook needle 24 shown also in FIG. 1.

Instead of the operation illustrated in FIG. 1, where the stitch or mesh structure 16 is produced by the knit thread 4 and in doing so the loop heads of the support ribbon weft thread 12 are engaged, the opposite approach could be taken and the loop heads 15 of the support ribbon weft thread 2 could be knitted together and the loop heads 15 could be guided beforehand through the interior of the loop heads 13 of the main knit thread 4.

The zipper half 3*a* illustrated in FIG. 1*a* is designed substantially according to the zipper half 3 illustrated in FIG. 1. The difference is only that the closing members 8c in the closing member row 17 are arranged at the same spacing to one another as the double picks 25 of the support ribbon weft 2 and the double picks 12 of the main knit thread 4. In the zipper half 3 of FIG. 1 the spacing of the closing members 8*c* was twice as large.

In FIG. 1*b* a further variant of FIG. 1 of a zipper half 3*b* is illustrated. It is characterized by an additional auxiliary thread 9 which reinforces interlocking of the closing member row 17 with the woven strip 38. In addition to the lifting needle 22 for the main knit thread 4, already explained in connection with FIG. 1 and FIG. 4, and the hook needle 24 for the knit thread 4, a second lifting needle 23 is provided which operates between the support ribbon warp threads 6 and the warp threads 6*a*. Moreover, the loop heads resulting from the auxiliary thread 9 are interlocked by crocheting by means of a second hook needle 34.

Figure 4A:
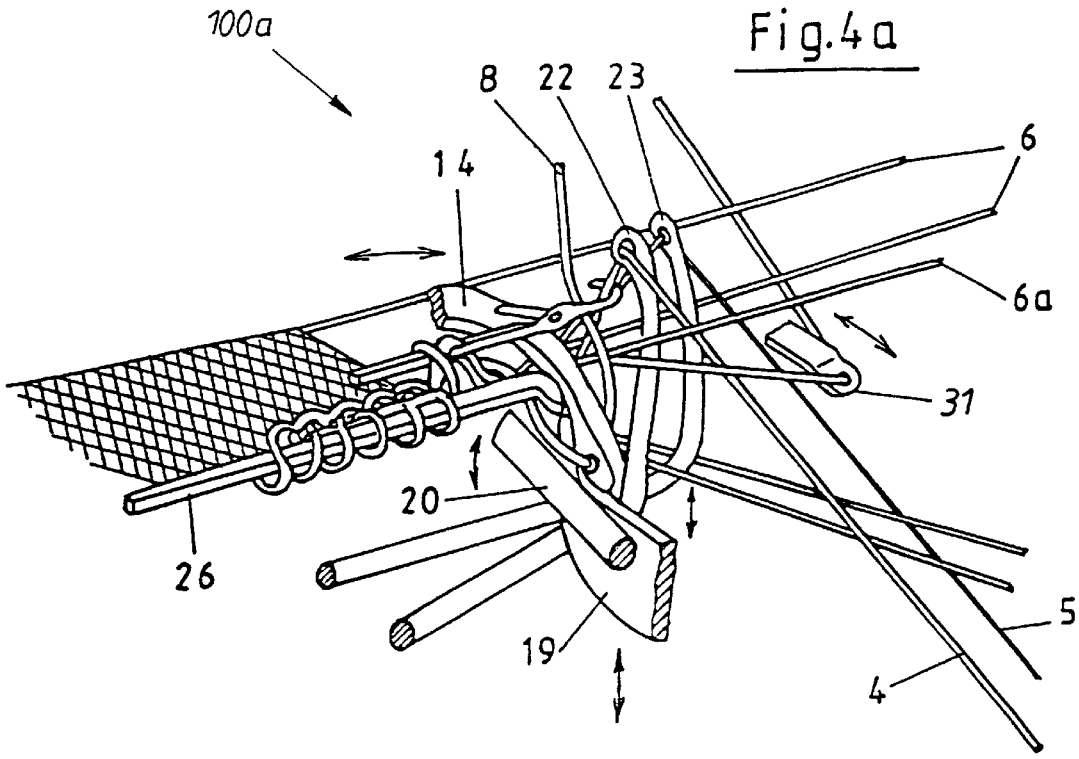
FIG. 4*a* is a variant of the conditions illustrated in FIG. 4, where, in addition to the knit thread, a second auxiliary thread is supplied by a lifting needle.

In the embodiment of FIG. 1*c* the zipper half 3*c* has an additional knit thread 5. As can be seen in FIG. 4*a*, the additional knit thread 5 is also guided by the second lifting needle 23 in the form of a loop between the closing members 8*c* of the closing member row 17, but, in contrast to FIG. 1*b*, the resulting loop heads are interlocked by the same hook needle 24 which also processes the loop heads 13 of the knit thread 4. This second lifting needle 23 operates in the area between the support ribbon warp threads 6 and the warp threads 6*a* of the woven strip 38.

The zipper half 3*d* illustrated in FIG. 1*d* has basically the same configuration as the zipper half 3 of FIG. 1. The difference is only that in the area of the closing member row 17 special warp threads 7 are used. The special warp threads 7 are also interlocked by the double picks 12 in the woven strip 38 but extend above the windings of the individual closing members 8*c*. The closing member row is additionally covered with these special warp threads 7. The winding arcs of the plastic monofilament thread 8 in this case are not covered by the mesh or stitch structure 16 but are also covered and secured relative to the woven material or 1 by woven material parts of the warp threads 7 and the double picks 12 of the main knit thread 4. The closing member row 17 can be pre-manufactured by coil-like or similar windings of the plastic monofilament yarn 8 and can be subsequently interlocked by double picks 12 with the woven fabric or the adjacent support ribbon 2.

Figure 2:
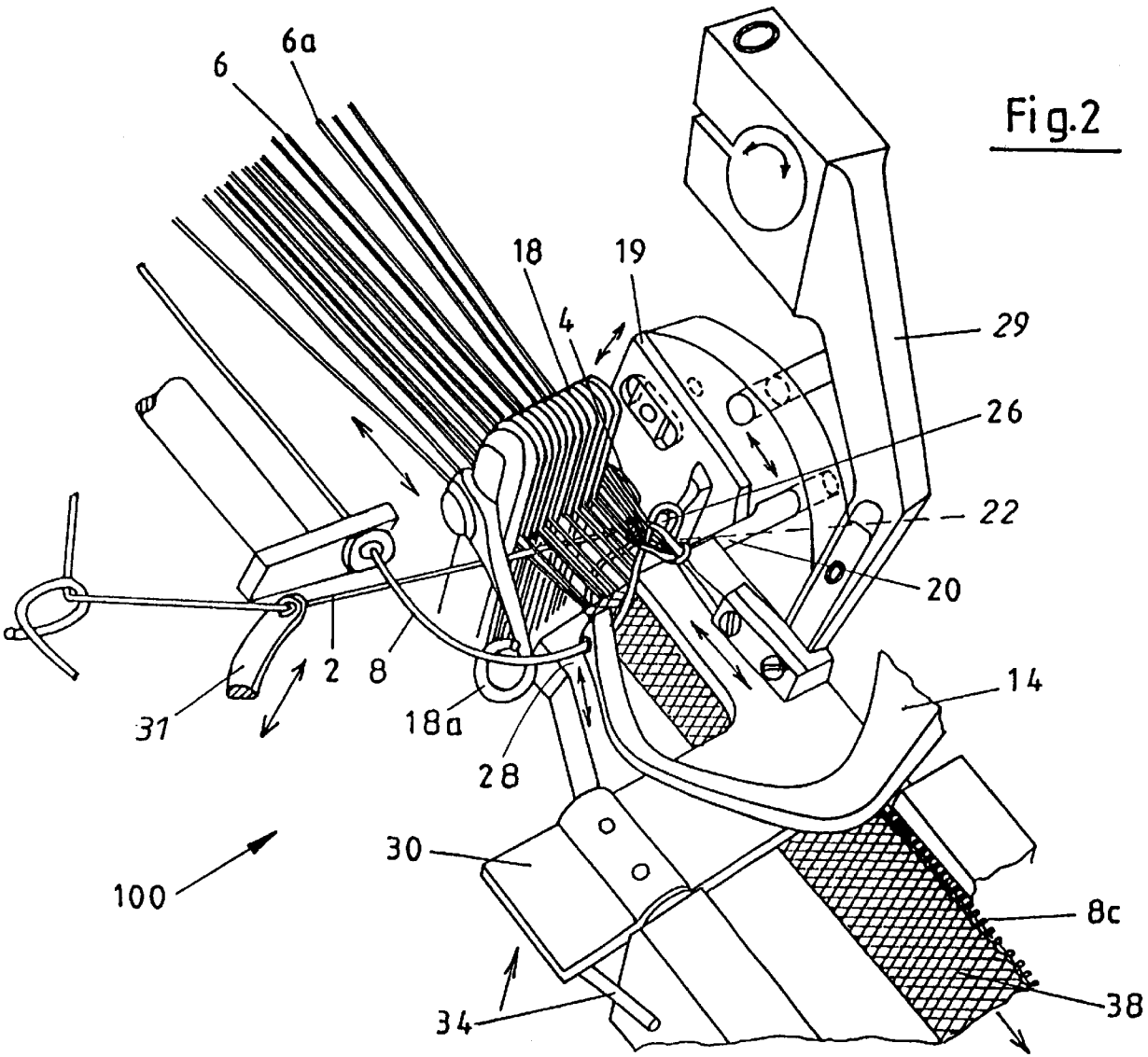
FIG. 2 is a perspective view of a portion of a needle ribbon weaving machine for manufacturing the zipper half of FIG. 1.

In FIG. 2, a device for manufacturing the zipper half 3 of FIG. 1 is illustrated. The device is a needle ribbon weaving machine 100 which is illustrated in a simplified form. A weaving phase is illustrated in which the weaving reed 18 is positioned shortly before the stop. The support ribbon weft thread 2 is picked into the shed formed by the warp threads 6 and has been caught by the knit thread 4 interlocking the additional warp threads 6*a*. The knit thread 4 has been received with its loop head in a hook needle 22 and engages behind the still large winding of the plastic monofilament thread 8 for producing the closing members 8*c*. The weaving reed 18 is connected to a return device 18*a* for the monofilament winding. The weaving reed 18 which can be moved in the direction of the double arrow pulls away the large monofilament winding by means of the return device 18*a* and places the plastic monofilament thread 8 about a pin 26 which serves to guide the resulting closing members 8*c*. A loop lifter 19 is provided which is movable in the direction of the illustrated arrows and supports the placement of the monofilament winding. Moreover, a positioning device 20 is provided which is illustrated in its rear position.

Figure 3:
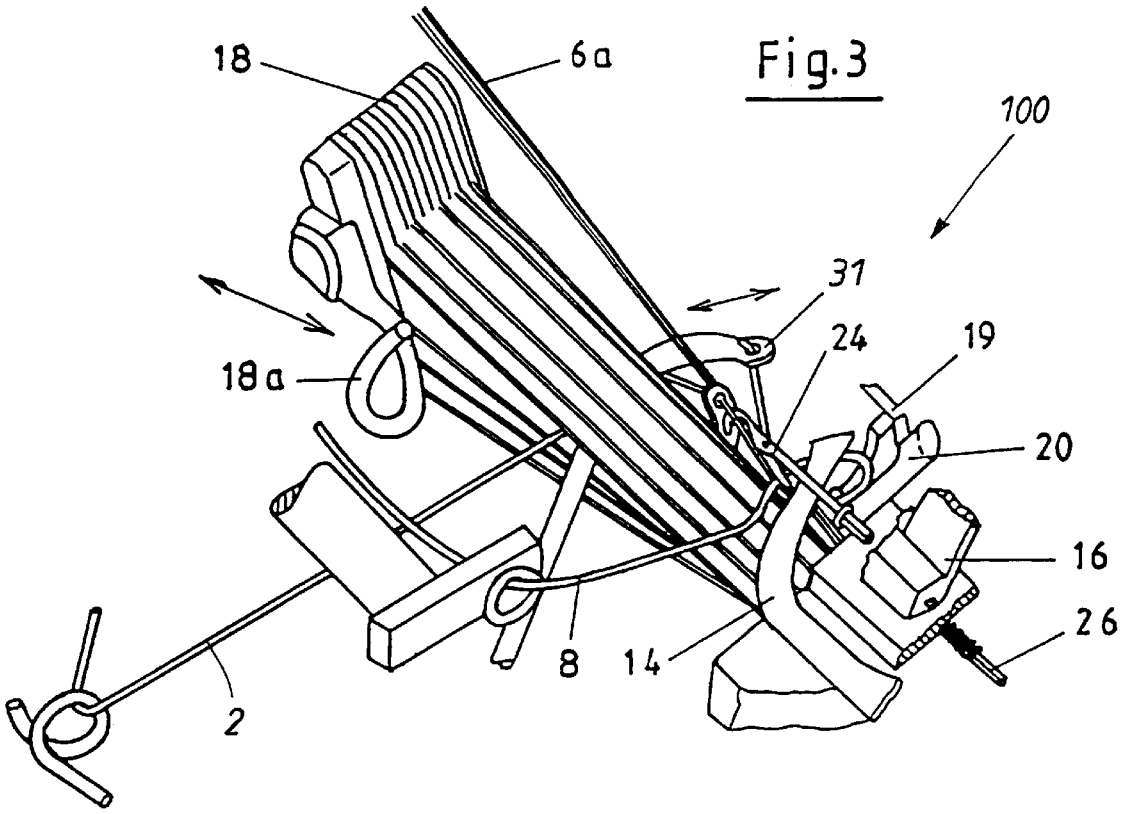
FIG. 3 is a further perspective view of the needle ribbon weaving machine according to FIG. 2, with a closing member row being produced.

FIGS. 3 and 4 show the cooperation of some of the machine components of the weaving machine 100 during weaving. With respect to FIG. 2 a different weaving phase is illustrated. The weaving reed 18 is positioned in the rearward area of its stop movement. In FIG. 4, the lifting needle 22 guiding the knit thread 4 has penetrated a shed formed by the warp threads 6*a*. Accordingly, the knit thread 4 has been moved to a reciprocating hook needle 24 which receives the knit thread 4. A monofilament placement needle 14 for the plastic monofilament thread 8 is provided. This monofilament placement needle 14 is shown in its placement position. With the aid of the upwardly movable loop lifter 19, the monofilament thread 8 is formed to a winding and placed about the closing member guiding pin 26 when the monofilament placement needle 14 performs a return movement. Simultaneous to the movement of the loop lifter 19, the positioning device 20 also moves into its rearward position in order to allow winding about the closing member guide pin 26. The positioning device 20 provides identical spacing of the continuously newly formed closing members 8*c*. Upon return movement of the monofilament placement needle 14 the knit thread 4 engages behind the formed monofilament winding. The picking means 31 for the support ribbon weft thread 2 can be seen in FIGS. 3 and 4.

In order to ensure a collision-free penetration of the lifting needle 22, the warp threads 6*a* to be interwoven with the knit thread 4 are guided at an angle of 6° to 10°. The lifting needle 22 is reciprocating at an angle to the shed. The closing member guide pin 26 is floatingly supported. The plastic monofilament thread 8 is guided by means of the monofilament placement needle 14 below the pin 26. After each placement of a monofilament winding the closing member guide pin 26 is returned into the starting position by means of the reciprocating positioning device. On the floating closing member guide pin 26 at least five monofilament windings are present in order to facilitate the weaving action.

In analogy to the illustration of FIG. 4, FIG. 4*a* shows a variant embodiment 100*a* of the afore described needle ribbon weaving machine. This machine 100*a*, as has been mentioned above, serves to produce the zipper half 3*c* illustrated in FIG. 1*c*. In FIG. 4*a* the aforementioned second lifting needle 23 can be seen which is illustrated, as the first lifting needle 22, in the picking position of its additional knit thread 5. The movement path of the second lifting needle 23 deviates from that of the first lifting needle 22. The movement path of the lifting needle 23 is substantially a vertical up and down movement. It is carried out close to the weaving reed between the support ribbon warp threads 6 and the slantedly guided warp threads 6*a* for the woven strip 38.

Figure 4B:
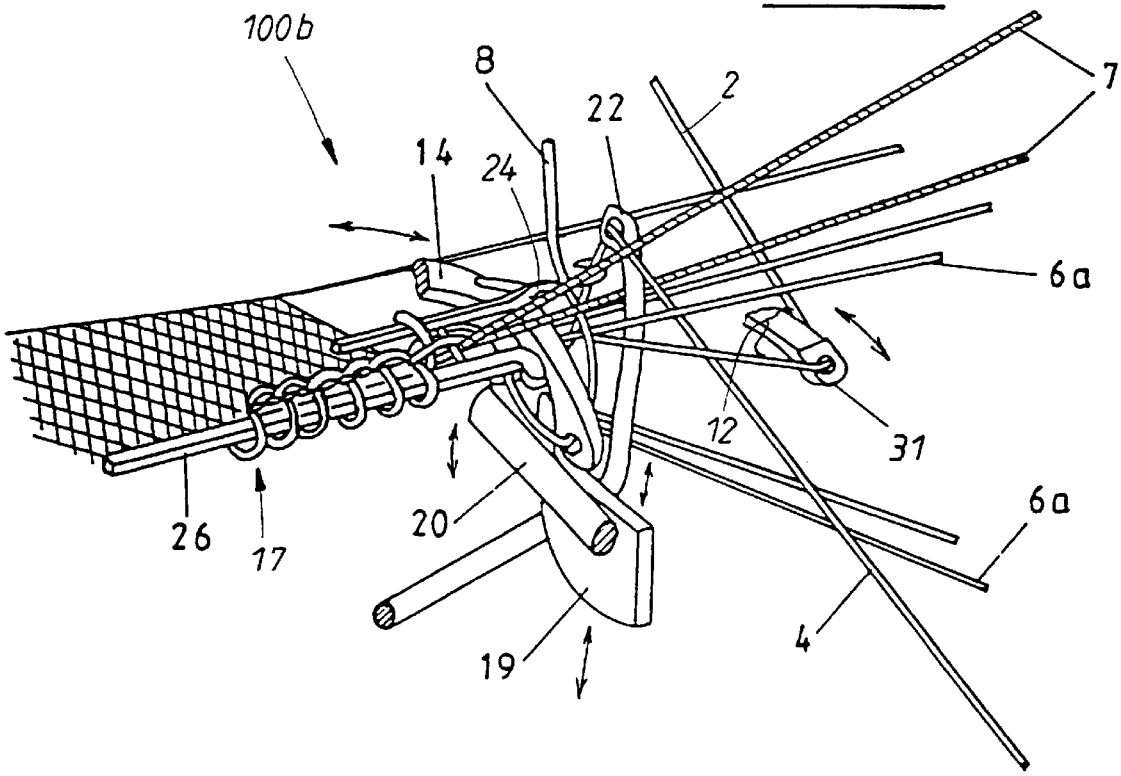
FIG. 4*b* is a variant of FIG. 4, wherein, at the upper side special warp threads are placed onto the closing member row in order to produce the product according to FIG. 1*d;*

FIG. 4*b* shows a further variant embodiment 100*b* of the needle ribbon weaving machine, again in a position analog to that of FIG. 4 with respect to the machine parts. This machine 100*b* is designed for manufacturing the zipper half 3*d* of FIG. 1*d*. The difference with respect to the weaving machine 100 resides in the use of the already aforementioned special warp threads 7 of which at least two are provided. The two warp threads 7 are guided oppositely during change of shed so that the two warp threads 7 are positioned alternatingly at the inner side of the lifting needle 22 for the lower warp threads 6a and at the outer side of the lifting needle 22 for the upper warp threads 6*a*. For the already aforementioned slanted movement path of the lifting needle 22 relative to the shed, the knit thread 4 is guided such that it penetrates above the warp threads 6*a* positioned in the lower shed but below the warp threads 6*a* positioned in the upper shed and at the same time penetrates between the two spread warp threads 7. Accordingly, the knit thread 4 reaches the level of the hook needle 22 where the knit thread 4 is then crocheted with its loop heads. The hook needle 22, as can be seen in FIG. 2, is supported and reciprocated by a carrier 29. For the picking of the support ribbon weft in the form of the double loops 12 the weft picking needle 31 is provided. The knit thread 4, in the form of double picks, is crossed with the warp threads 6*a* in the woven strip 38 below the closing member row 17 but also, as illustrated in FIG. 1*d*, with the special warp threads 7 at the upper side of the closing member row 17.

The FIGS. 5*a* to 6*b* show details of the device of FIGS. 2 through 4. On a weaving support 28 a cover 30 is arranged with spring action which serves for guiding the closing member row 17 illustrated in FIGS. 6*a* and 6*b*. The front part of this cover 20 serves as a stamping die 32. As can be seen in FIGS. 6*a* and 6*b*, the plastic monofilament thread 8 is guided into the space between the stamping die 32 and the rods 18*b* of the weaving reed 18. Accordingly, the initially round cross-section of the monofilament thread 8 is flattened at the locations indicated by reference numeral 35 in FIGS. 6*a* and 6*b*. A spring 36, illustrated in FIGS. 5*a* and 5*b*, acts on the cover 30 of the closing member guide.

As is illustrated in FIG. 6*b*, the rods 18*b* have a certain spacing to the stamping die 32. When winding the plastic monofilament thread 8 about the closing member guide pin 26, the deformations 35 will be positioned at a right angle to the weaving plane. With these formations 35 the shaping of the locking member 8*c* can be affected favorably. The notch depth of the deformations 35 can be adjusted by an adjusting screw 32 illustrated in FIG. 6*b*. With these notches 35 the interlocking heads 8*d* for the closing members 8*c* to be formed thereof are produced when the plastic monofilament thread 8 is wound to a coil. The spacing between the individual notches 35 is selected according to the length of the closing member 8*c* to be formed. The rods 18*b* in the weaving reed 18 are spaced accordingly.

While specific embodiments of the invention have been shown and described in detail to illustrate the inventive principles, it will be understood that the invention may be embodied otherwise without departing from such principles.

What is claimed is:

1. A method for manufacturing a woven zipper half, the method comprising the steps of:

producing a woven strip of warp threads and of at least one weft thread, wherein the weft thread is picked in the form of double pick loops;

winding a plastic monofilament to form a wound closing member row comprising member-forming windings having interlocking heads at one end and winding reversing portions at the other end, wherein the closing member row is positioned on the woven strip;

positioning additional warp threads underneath the closure member row;

during weaving, guiding at least one main knit thread in the upward direction through gaps between the member-forming windings to the upper side of the closing member row to form loops with loop heads;

interlocking the loop heads of the at least one main knit thread at the upper side by crocheting, wherein the loop heads after crocheting form a mesh structure covering portions of the upper side of the closure member row and interlock the closure member row with the woven strip; and simultaneously to interlocking of the loop heads at the upper side, forming double pick loops of the loop-shaped main knit thread and interlacing the double pick loops during weaving with the additional warp threads and using the main knit thread as a weft thread in the woven strip underneath the closing member row.

2. The method according to claim 1, wherein the step of interlocking is performed by direct interlocking of the loop heads of the main knit thread to form the mesh structure.

3. The method according to claim 1, wherein the step of interlocking is carried out by an indirect stitch interlocking by at least one auxiliary thread.

4. The method according to claim 1, further comprising the steps of guiding at least one additional knit thread in the form of loops through the gaps between the adjacent windings of the closing member row and interlocking directly or indirectly loop heads formed by the additional knit thread with one another or with the loop heads of the main knit thread or with one another as well as with the loop heads of the main knit thread to form the mesh structure.

5. The method according to claim 1, further comprising the steps of providing special warp threads at the upper side of the closing member row opposite the woven strip and interlocking the special warp threads with the double picks of the main knit thread to form a woven product covering portions of the closing member row.

6. The method according to claim 1, comprising the step of weaving the woven strip supporting the closing member row and a support ribbon adjoining the woven strip to one another, wherein the support ribbon is produced of support ribbon warp threads and a support ribbon weft in the form of double pick loops, and wherein the loops of the main knit thread are guided, when penetrating the gaps between the windings of the closing member row, through the loop heads of the support ribbon double pick before the loop heads of the main knit thread are interlocked with one another at the upper side of the closing member row, and wherein the main knit thread thus not only interlocks the woven strip with the closing member row but also the support ribbon with the woven strip.

7. The method according to claim 6, wherein during weaving of at least one of the woven strip and the support ribbon the plastic monofilament thread is wound simultaneously in a weaving step to form the closing member row, wherein the formed closing member row is simultaneously interlocked by the main knit thread with the woven strip.

8. The method according to claim 7, wherein the weaving step comprises guiding the plastic monofilament thread under a closing member guide pin, upwardly deflecting the plastic monofilament thread, and returning the plastic monofilament thread to form a winding by surrounding the closing member guide pin, wherein at the same time a weft thread loop of the support ribbon weft thread is picked into the shed of the warp threads of the support ribbon and is caught at the side facing the closing member row of the support ribbon by the main knit thread guided upwardly at a slant, the main knit thread then being received in a hook needle, formed to a loop head, and interlocked by crocheting in front of the plastic monofilament winding, wherein the weft thread loop, the plastic monofilament winding, and the main knit thread are then beat up on a weaving reed and the plastic monofilament winding is then adjusted with regard to length and shape by means of a loop return device integrated into the weaving reed.

9. The method according to claim 8, wherein the locking member row is produced as a continuous plastic monofilament with a pre-stamped portion, subsequently the winding arcs of the monofilament are bent at the pre-stamped portion in a forward area opposite the winding reversing portions and form substantially congruently stacked closing members which are then interlocked with the main knit thread.

10. The method according to claim 8, wherein the closing member guide pin is floatingly guided through the wound closing members and is secured at a predetermined spacing by a positioning device after each picking of a new continuously formed closing member.

11. The method according to claim 8, wherein the plastic monofilament thread is notched during weaving by the weaving reed.

12. The method according to claim 6, wherein, relative to the spacing of the closing members in the closing member row, the support ribbon weft and the main knit thread are single-picked or double-picked into the support ribbon and the woven strip.

13. The method according to claim 1, wherein, relative to the spacing of the closing members in the closing member row, the support ribbon weft and the main knit thread are single-picked or double-picked into the woven strip.

14. The method according to claim 1, wherein the plastic monofilament thread is supplied for weaving with minimal tension.

15. The method according to claim 1, wherein the closing member row is pre-manufactured by winding a plastic monofilament thread in a coil-shape or other continuous winding, wherein the pre-manufactured closing member row is subsequently interlocked by the double pick loops with the woven strip.

* * * * *